US005344031A

United States Patent [19]

Jarecki et al.

[11] Patent Number: 5,344,031

[45] Date of Patent: Sep. 6, 1994

[54] STRUCTURE FOR DISPLAYING AND SELLING ARTICLES

[75] Inventors: James J. Jarecki, Greendale; Jason R. Landmark, Milwaukee, both of Wis.

[73] Assignee: EZ Paintr Corporation, Milwaukee, Wis.

[21] Appl. No.: 960,155

[22] Filed: Oct. 14, 1992

[51] Int. Cl.[5] ..... A47F 5/00

[52] U.S. Cl. ..... 211/59.1; 211/181

[58] Field of Search ..... 211/59.1, 181, 204, 211/119

[56] References Cited

U.S. PATENT DOCUMENTS

| | | | |
|---|---|---|---|
| 543,025 | 7/1895 | Knopf | 211/204 |
| 1,752,985 | 4/1930 | Huffman | 211/181 X |
| 2,626,061 | 1/1953 | Girouard | 211/59.1 |
| 3,172,539 | 3/1965 | Rulf | 211/59.1 |
| 5,031,783 | 7/1991 | Goudreau | 211/59.1 X |
| 5,215,199 | 6/1993 | Bejarano | 211/181 X |

*Primary Examiner*—Alvin C. Chin-Shue
*Assistant Examiner*—Sarah A. Lechok
*Attorney, Agent, or Firm*—Baker & McKenzie

[57] ABSTRACT

An improved display structure is provided for displaying articles in confined spaces. The display structure includes two vertical supports that may be placed on the floor or suspended from a ceiling. A horizontal frame member extends between the two vertical supports. The horizontal frame member includes at least three distinct portions including an upper rectangular frame for the display of product indicia, a middle horizontal display area ideally suited for pegboard-type display and a lower horizontal hanging area for hanging products. When the display structure is mounted to the floor, the lower area between the two vertical supports may be used for displaying additional products or the display structure may be constructed around an existing counter, display or cashier's station.

14 Claims, 3 Drawing Sheets

10
26
25
27
74
18
41
42
38
52
53
30
43
31
32
33
37
34
22
39
35
21
36
55
54
44
45
46
16
-47-
17
14
13
48
19
23
11
24
19
12
19
48
15

STRUCTURE FOR DISPLAYING AND SELLING ARTICLES

This invention relates generally to an improved display structure for the displaying and selling of articles in confined spaces. More particularly, the invention relates to a versatile product display structure that may be placed on a floor, on a counter, or suspended from a ceiling.

BACKGROUND OF THE INVENTION

This invention is directed to the display of products in retail stores. Often, stores that sell a wide variety of products have limited amounts of floor space and shelf space for each line of products. One example of a type of store that generally suffers from insufficient amounts of floor and shelf space is the "convenience" store. In the United States, the "convenience" store has become a popular style of retailing. Convenience stores are small stores that can often be associated with gas stations. Convenience stores sell a wide variety of goods ranging from food items to hardware items. As a result of the relatively small amount of floor space and shelf space, manufacturers and wholesalers who market goods in small stores like convenience stores find themselves competing for sufficient amounts of floor space and shelf space in order to adequately display their products.

In countries other than the United States, such as Mexico, many types of stores, including convenience stores, are relatively small. Therefore, in countries where many stores are small, manufacturers, wholesalers and retailers must find efficient ways to display products in the limited space that is available.

In any retail store and especially in a small store, it is essential to use all the available space efficiently. Currently, many areas of small stores are under utilized. One area that is commonly under utilized in many small stores is the area above a counter between the counter and the ceiling. Further, in many foreign countries, the area in the back of the store above the cash register is commonly left entirely unused. Further, the space adjacent to a wall above a shelf or a product display is commonly left unused. Finally, the air space above an aisle of goods or a shelf of goods in the middle of the store floor is often left unused.

Therefore, there is a need for an attractive and efficient way to display goods above and around existing counters and product displays and in the areas above a counter between the counter and ceiling.

BRIEF DESCRIPTION OF THE INVENTION

The present invention makes a significant contribution to the product display art by providing an improved structure for displaying products above and around existing product displays and above existing counters or cash registers. The present invention provides a structure for displaying products that may be placed on the floor, on a counter or suspended from the ceiling. Thus, one structure satisfies a variety of display needs.

The improved display structure of the present invention includes means for providing vertical support for a horizontal frame member. The means for providing vertical support for the horizontal frame member preferably includes two T-shaped members. Each T-shaped member includes one elongated vertical arm and a shorter base member that is perpendicularly mounted to each vertical arm. The horizontal frame member is attached to and suspended between one end (the first end) of each vertical arm. A base member is perpendicularly mounted to a second end of each vertical arm. The base members may be placed on the floor or on a counter where they would provide support for the entire display structure. Alternatively, the base members may be mounted to a ceiling so that the entire display structure is suspended from the ceiling.

When the display structure is assembled, the horizontal frame member is suspended between a right T-shaped member and left T-shaped member. An upper portion of the horizontal frame member may include an area for the display of indicia. Alternatively, a header that includes a separate unit that clamps onto the horizontal frame member may be employed for the display of indicia. A middle portion of the horizontal frame member includes a middle horizontal hang means. Preferably, the middle horizontal hang means accommodates pegboard-style hooks. The hooks extend outwardly from the middle horizontal hang means and products may be conveniently hung from the hooks.

The horizontal frame member also includes a lower horizontal hang means. Preferably, the lower horizontal hang means includes a single horizontal bar extending from the right side of the horizontal frame member to the left side of the horizontal frame member. Additional products may be hung from this lower horizontal bar. The lower horizontal hang means may also include a means for accommodating pegboard-style hooks in addition to or as an alternative to the single horizontal bar.

When the display structure is placed on the floor or on a counter, the two base members of the T-shaped members engage the surface of the floor. The horizontal frame member is attached to the upper ends, or first ends of the vertical arms. The area for displaying indicia is at the top of the horizontal frame member. Alternatively, when the display structure is to be hung from the ceiling, the base members are mounted to the ceiling and the two vertical arms are suspended downward. The horizontal frame member is attached to the vertical arms but has been rotated 180° so that the upper area for the display of indicia is still disposed on top of the horizontal frame member.

Alternatively, two display structures can be mounted to the floor in a back-to-back fashion to create a two-sided display with an area for stacking goods beneath the horizontal frame members on the floor below. Another alternative includes length-adjustable T-shaped members for vertical height adjustment of the display structure. The length-adjustable T-shaped members include male and female members with through-holes that accommodate bolts for length, or height adjustment.

It is therefore an object of the present invention to provide a single display structure that may be suspended from the ceiling, placed on the floor or placed on a counter top, all for the efficient display of products in a confined space.

It is another object of the present invention to provide a structure for the display of products around an existing counter or cash register stand.

It is still another object of the present invention to provide a display structure for the display of products above a lower existing product display.

Yet another object of the present invention is to provide an improved display structure that may be suspended from the ceiling above an existing product display or cashier station.

BRIEF DESCRIPTION OF THE DRAWINGS

This invention is illustrated more or less diagrammatically in the accompanying drawings, wherein:

FIG. 3 is a partial front view of a horizontal frame member made in accordance with the present invention as attached to a left T-shaped member;

FIG. 4 is a right side view of the horizontal frame member shown in FIG. 3;

FIG. 5 is a partial right side view of the second end of the left T-shaped member shown in FIG. 3;

FIG. 6 is a partial left side view of the first end of the left T-shaped member shown in FIG. 3; and FIG. 7 is a partial right side sectional view of the elongated rectangular frame of the horizontal frame member shown in FIG. 3 and particularly illustrating the slot for inserting and removing promotional placards and the like.

DETAILED DESCRIPTION OF THE INVENTION

Figure 1:
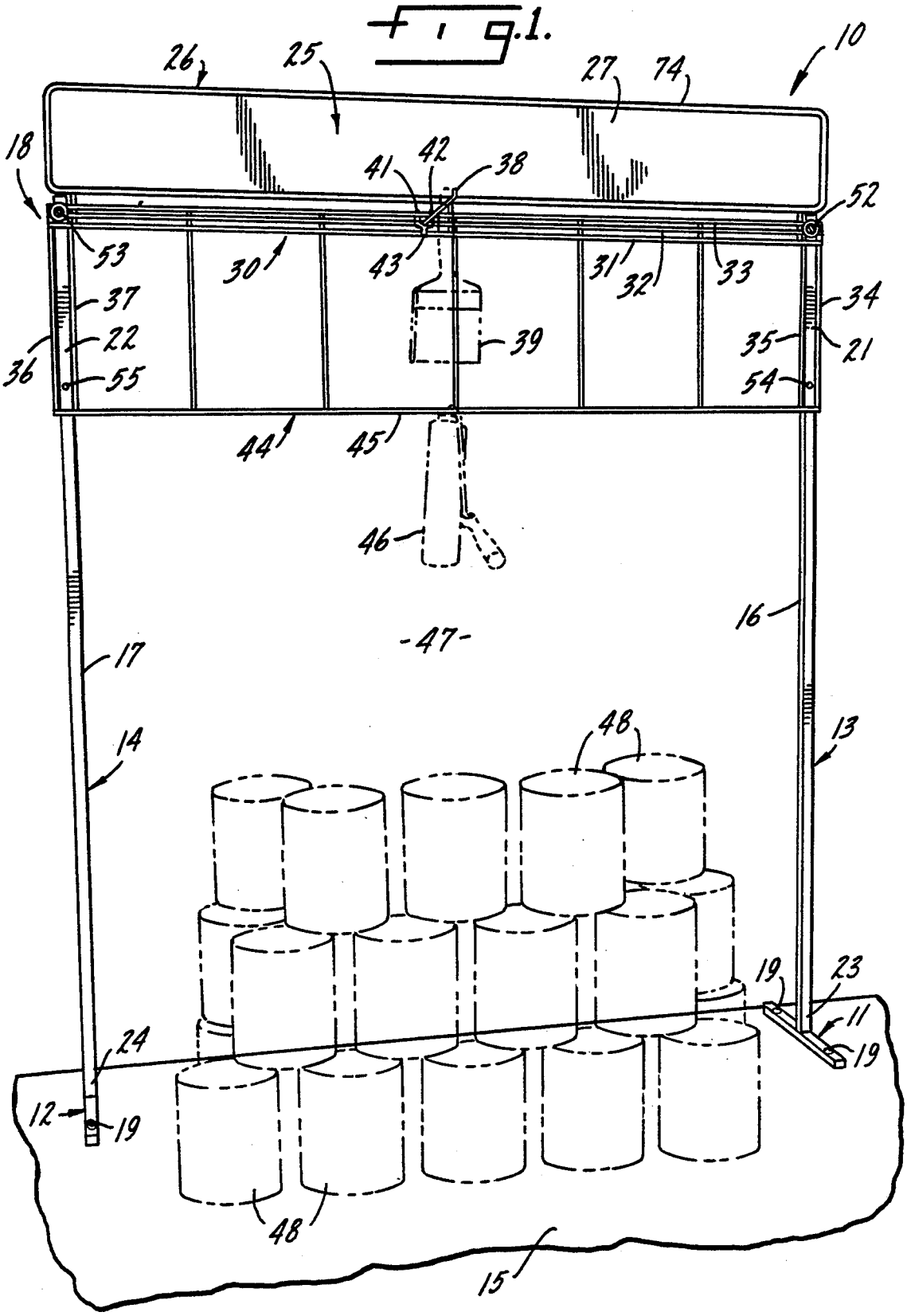
FIG. 1 is a front elevational view of a display structure made in accordance with the present invention wherein the structure is mounted to a floor above and around an existing product display.

Like reference numerals will be used to refer to like or similar parts from figure to figure in the following description of the drawings.

The present invention provides an effective and simplified solution to the aforenoted space problems of smaller stores. The single design of the present invention provides three different display systems. First, the display structure of the present invention may be suspended from the ceiling. After rotating the horizontal frame member 180°, the display structure of the present invention may be alternatively mounted on the floor. Third, a shorter display structure of the present invention may be mounted onto a counter top. Thus, the display structure of the present invention may take advantage of wasted space above existing shelves, displays, cash registers, counters and the display structure of the present invention may be built around an existing display.

As seen in FIG. 1, the display structure 10 of the present invention is shown in an upright floor mount position. The base members 11, 12 of the right T-shaped member 13 and left T-shaped member 14 respectively are attached to the floor 15. For stability, the right base member 11 and left base member 12 are firmly mounted to the floor, with the plurality of bolts, shown generally at 19.

The right and left T-shaped members 13, 14 include elongated vertical arms 16, 17. The horizontal frame member, shown generally at 18 is attached to the upper (or first) ends 21, 22 of the elongated vertical arms 16, 17, respectively. The lower (or second) ends 23, 24 of the elongated vertical arms 16, 17 are fixedly attached as by welding to the base members 11, 12.

The horizontal frame member 18 includes an upper frame area 25 that can be used for the display of product indicia, such as trademarks and other product information. The upper frame area is bound by an elongated rectangular frame 26 which is U-shaped in cross section. The product indicia is printed on a board or placard 27 that can be inserted and removed from the rectangular frame 26 through a slot 28 disposed in the right end of the frame 26 (see FIG. 4 and 7). Alternatively, the frame 26 may be removed and replaced by a header that detachably clamps onto the horizontal frame member 18.

The horizontal frame member 18 also includes a middle horizontal hang means, shown generally at 30. In the preferred embodiment shown in FIG. 1, the middle horizontal hang means 30 includes three relatively parallel and horizontal bars 31, 32, 33. The horizontal bars 31, 32, 33 extend from the right side of the horizontal frame member 18 which includes the right vertical bars 34, 35 to the left side of the horizontal frame member 18 which includes the left vertical bars 36, 37. The spacing of the horizontal bars 31, 32, 33 provides for easy insertion of a pegboard-type hook shown at 38. The two upwardly protruding prongs 41, 42 engage the rear side of the upper bar 33 while the downwardly protruding front prong 43 engages a front side of the lower bar 31. As seen in FIG. 1, the pegboard-type hook 38 is ideal for the hanging display of paint brushes 39 and other articles suitable for hanging-type display.

The horizontal frame member 18 also includes a lower horizontal hang means shown generally at 44. In this preferred embodiment, the lower horizontal hang means 44 is a single horizontal bar 45 that extends from the right vertical bars 34, 35 to the left vertical bars 36, 37. An additional rear horizontal bar 67 may be added for structural stability of the horizontal frame member 18 and to provide a more stable hanging arrangement (see FIG. 4).

Alternatively, a series of parallel bars like those shown at 31, 32, 33 may be mounted between the lower bar 45 and middle bars 31, 32, 33 to provide an additional row of pegboard-style display. The lower bar 45 may also be replaced by three parallel bars such as 31, 32, 33 for two rows of pegboard-style display.

The horizontal frame member 18 is mounted to the first ends 21, 22 of the vertical arms 16, 17 by the two bolt and wing-nut combinations shown at 52, 53. The bolts (FIG. 6) pass between the horizontal bars 32, 33. The bolt holes 54, 55 are unused in the configuration shown in FIG. 1, but as shown below, the bolt holes 54, 55 are used to mount the horizontal frame member 18 to the arms 16, 17 in the inverted configuration shown in FIG. 7. As seen in FIG. 1, the lower horizontal bar 45 is ideal for the hanging display of paint rollers 46 and other articles suitable for this type of display.

The configuration of the display structure 10 shown in FIG. 1 is ideal for the display of a row of goods along the middle horizontal hang means 30 and another row of goods along the lower horizontal hang means 44. The area below the lower horizontal hang means 44, shown generally at 47, is not wasted. The area 47 will normally be occupied by a pre-existing counter, such as a cash register counter (not shown) or can also be used for the stacking display of other goods, such as cans of paint 48 that are stacked on the floor 15. As seen in FIG. 1, the display structure 10 occupies a relatively small amount of floor space yet still enables the manufacturer or wholesaler to display large quantities of goods. Alternatively, the configuration of the display structure 10 shown in FIG. 1 allows the manufacturer or retailer to build the display structure 10 around a preexisting counter or pre-existing display. Further, the display structure 10 may include shorter vertical arms 16, 17 or length-adjustable vertical arms 16, 17 or length-adjustable vertical arms 16, 17 and be suitable for mounting directly to a counter top over an existing product display or around a cash register.

It will also be noted that two display structures 10 may be mounted to a floor 15 in a back-to-back configuration for a two-sided display. This back-to-back configuration may also be employed for the ceiling-mounted configuration discussed in reference to FIG. 2 below.

Figure 2:
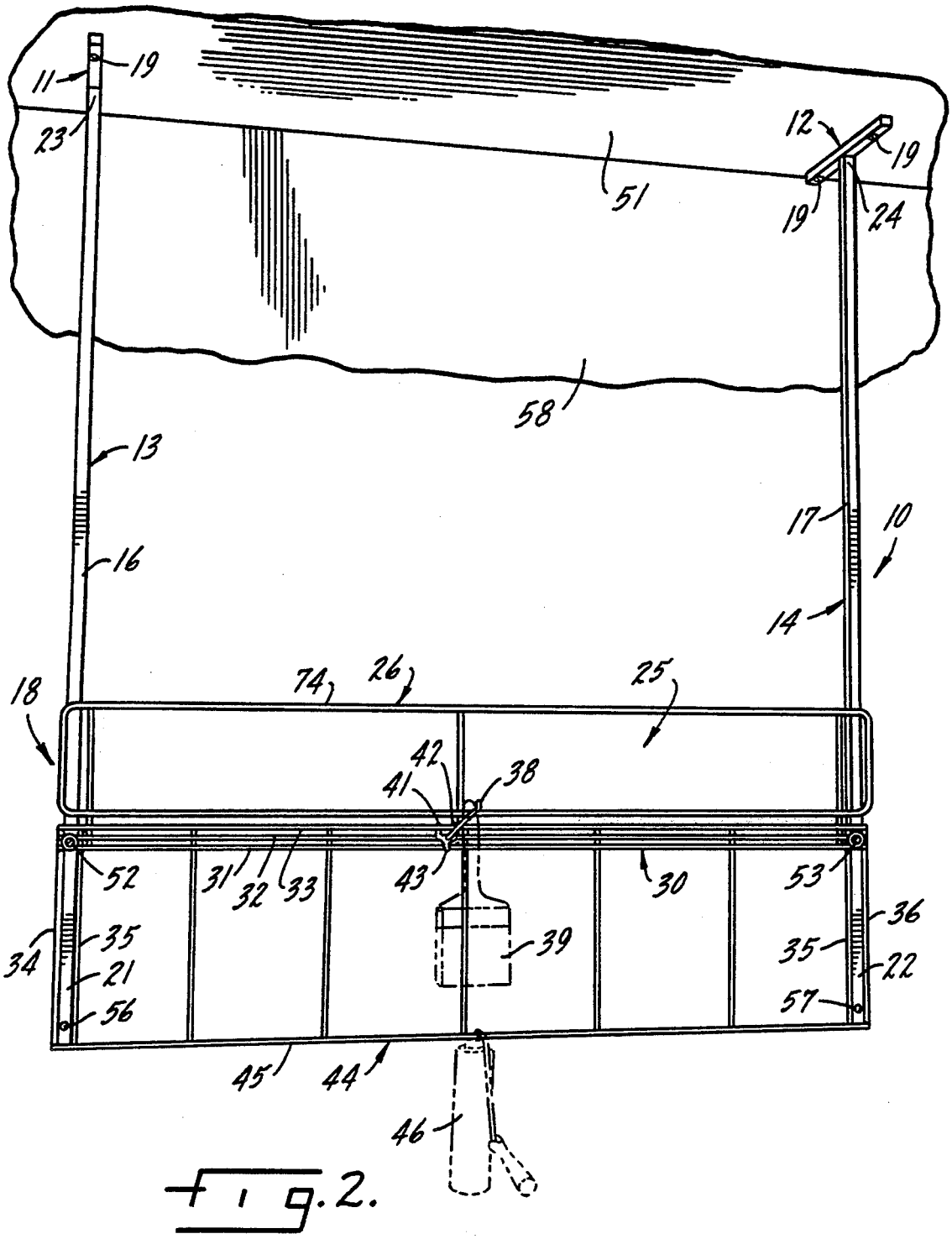
FIG. 2 is a front elevational view of the display structure shown in FIG. 1 wherein, the structure is suspended from a ceiling.

Turning to FIG. 2, the display structure 10, shown originally in FIG. 1, is shown in the inverted position, hanging from the ceiling 51. The base members 11, 12 are bolted to the ceiling 51 with bolts or other types of anchors, shown generally at 19. It will be noted that no substantial modifications have been made to the display structure 10 in order to hang the display structure 10 from the ceiling 51 as opposed to mounting the display structure 10 on the floor 15 (see FIG. 1). The only modifications have been the 180° rotation of the horizontal frame member 18 and the use of bolt holes 56, 57 for the ceiling mount, instead of bolt holes 54, 55 for the floor/counter mount.

The configuration shown in FIG. 2 is ideally suited for stores with high ceilings and relatively little floor space. The display structure 10 is hung from the ceiling and the horizontal frame member 18 may be disposed above a pre-existing shelf of goods and counter. Also, the display structure 10 need not be hung from a portion of the ceiling 51 near a wall 58, but may be hung over a pre-existing aisle of goods (not shown). The configuration shown in FIG. 2 is also ideally suited for hanging the display structure 10 over a cash register. The three horizontal bars 31, 32, 33 cooperate with the prongs 41, 42, 43 of hook 38 in the same manner in both the ceiling mount and floor/counter mount variations, thereby providing maximum mounting flexibility. Length-adjustable vertical arms 16, 17 would accommodate for ceilings of varying height.

Figures 3, 4, 5, 6, 7:
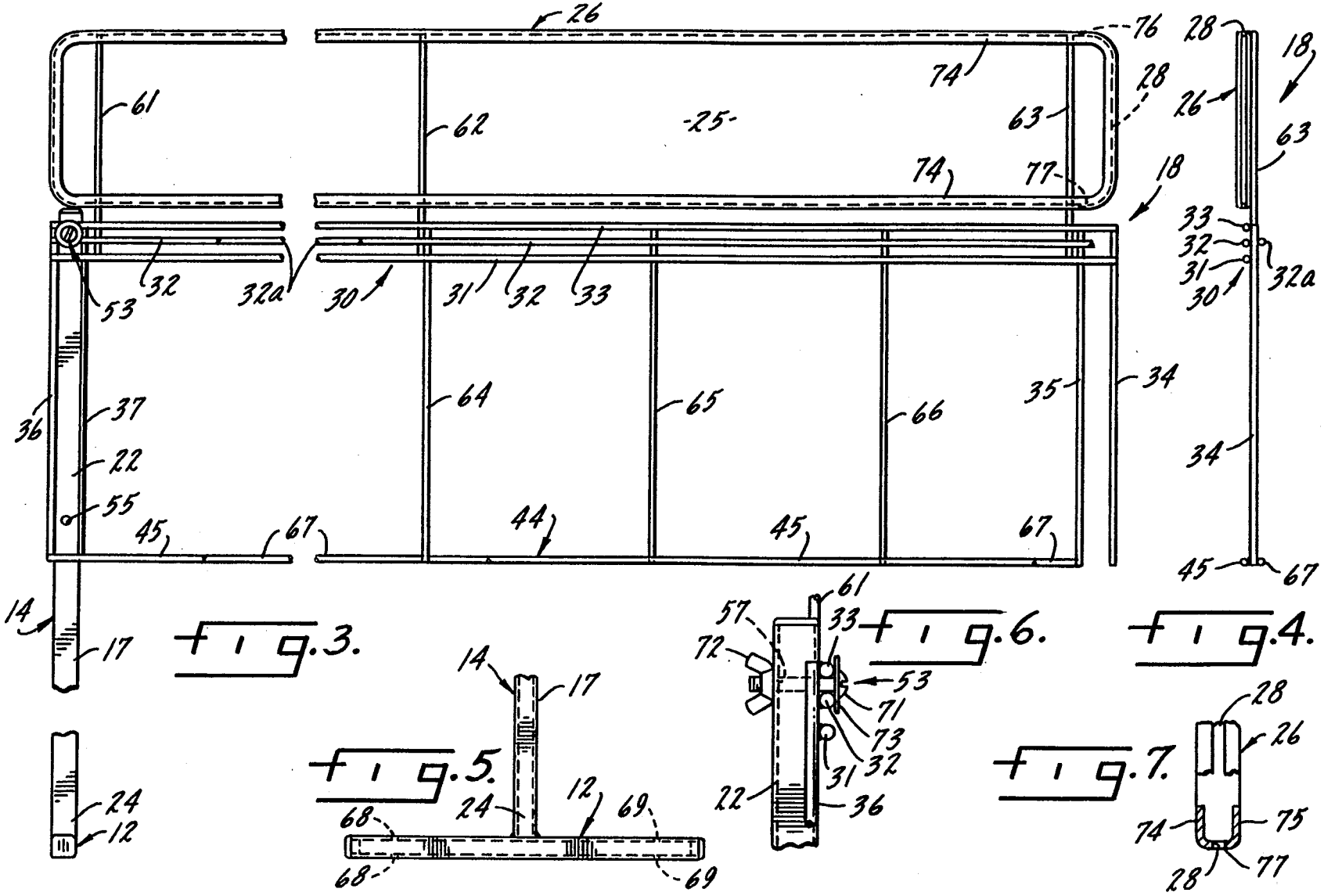

FIG. 3 is an illustration of the horizontal frame member 18 in greater detail. As mentioned, the upper frame area 25 is bound by elongated rectangular frame 26. The frame 26 provides support for a board or placard 27 (not shown in FIG. 3; see FIG. 1). The placard 27 may be inserted and removed through the slot 28 which is disposed in the right side of the frame 26. The frame 26 is supported by three vertical bars 61, 62, 63 which are welded to the horizontal bars 31, 32, 33 of the middle horizontal hang means 30.

The middle horizontal bars 31, 32, 33 of the horizontal hang means 30 are welded or otherwise attached to the outer vertical bars 34, 35, 36, and 37. As noted above, the horizontal hang means 30 provides a means for attaching the horizontal frame member 18 to the first ends 21, 22 of the T-shaped vertical support members 13, 14. In one preferred embodiment shown in FIG. 3, a bolt, washer and wing nut combination 53 is used to mount the horizontal frame member 18 to the first end 22 of the vertical arm 17 by passing of bolt between the horizontal bars 32, 33 of the horizontal hang means 30. Additional support for the frame members is provided by welding vertical bars 64, 65, 66 between the horizontal hang means 30 and the lower horizontal hang means 44. Finally, the stability of the structure is insured by the abutting engagement of the outer vertical bars 34, 35 and 36, 37 against the side surfaces of the first ends 21, 22 of each elongated vertical arm 16, 17.

One foreseeable embodiment mentioned above and not shown in the figures would include vertical arms 16, 17 that are length-adjustable so that the height of display structure 10 could be varied. One suitable embodiment would include vertical arms 16, 17 comprising male and female members with a series of through holes that accommodate bolts for height adjustment. Of course, a width-adjustable horizontal frame member could be fabricated enabling the entire display structure 10 to be width-adjustable.

FIG. 4 is a right side view of the right side of the horizontal frame member 18 shown in FIG. 3. As discussed above, the slot 28 is provided for the insertion and removal of the placard 27 (see FIG. 1). The vertical bar 64 is intended for additional structural support for the middle horizontal hang means 30 and also for the additional support for the pegboard-type hook 38 shown in FIGS. 1 and 2. In addition to providing structural integrity, the vertical bar 67 combines with the horizontal bar 45 of the lower hang means 44 to provide a wider hanging area for articles such as paint rollers 46 (see FIGS. 1, 2).

FIG. 5 is a side view of the lower (second) end 24 of the left vertical arm 17 and base member 12 shown in FIG. 3. The base member 12 is attached to the second end 24 by welding or other means of attachment. The bolt holes 68, 69 are provided for firmly mounting the base member 12 to a floor 15, a ceiling 51 or a counter top (not shown).

FIG. 6 is a detail view of the means of attachment of the horizontal frame member 18 to the first ends 21, 22 of the vertical arms 16, 17. A bolt 71 passes through the bolt hole 57 (see FIG. 2). A wing nut 72 and washer 73 combination provide a secure attachment of the horizontal bars 32, 33 to the first end 22 of the vertical arm 17. The vertical bars 36 and 37 positively engage the opposing sides of the first end 22 of the vertical arm 17. This positive engagement along with the clamping force exerted by the washer 73 and wing nut 72 combination add structural stability to the entire display structure 10.

FIG. 7 is a partial right-sectional view of the elongated rectangular frame 26, particularly illustrating the slot 28 for inserting and removing the board or placard 27 (see FIG. 1). The frame 26 is preferably U-shaped with sidewalls 74, 75 to accommodate a placard 27 and also includes the slot 28 at one side for the insertion and removal of the placard 27. The slot 28 extends from the upper end 76 to lower end 77, both ends 76, 77, being disposed to the right of the vertical bar 63 (see FIG. 3).

Thus, an improved display structure 10 is provided for displaying goods in relatively confined spaces. A single display structure 10 may be placed on a floor 15 or hung from a ceiling 51 or be mounted to a counter top. An alternative embodiment of the invention would include adjustable vertical arms 16, 17 for varying the height of the display structure 10.

Although a single preferred embodiment of the present invention and two configurations of that embodiment have been illustrated and described, it will be once apparent to those skilled in the art that variations may be made within the scope of the invention. Accordingly, it is intended that the scope of the invention be limited solely by the scope of the hereafter appended claims and not by any specific wording and the foregoing description.

We claim:

1. A structure for the displaying and selling of products in confined spaces, the structure comprising:

a horizontal frame member, means for providing vertical support for right and left sides of the horizontal frame member, the means for providing vertical support including a first end and a second end, means for detachably mounting the right and left sides of the horizontal frame member to the first ends of the means for providing vertical support, the horizontal frame member including an upper area for the display of indicia, at least one middle horizontal hang means for the displaying of products, and at least one lower horizontal hang means for the displaying of products, the middle horizontal hang means includes three parallel horizontal bars extending from the right side to the left side of the horizontal frame member, each second end of the means for providing vertical support including a base member, each base member supporting the structure when the second ends are placed on a lower horizontal surface, each base member also being mountable to an upper horizontal surface, whereby the second ends may be placed on a lower horizontal surface for an upright configuration of the structure and the second ends may be suspended from an upper horizontal surface for an inverted configuration of the structure.

2. The structure of claim 1, wherein the middle horizontal hang means accommodates pegboard style hooks for the hanging display of products.

3. The structure of claim 1, wherein the lower horizontal hang means includes at least one lower horizontal bar extending from the right side of the horizontal frame member to the left side of the horizontal frame member.

4. The structure of claim 1, wherein the means for providing vertical support of the right and left sides of the horizontal frame member is height adjustable thereby enabling the structure to be height adjustable.

5. A structure for the displaying and selling of products in confined spaces, the structure comprising:

a right T-shaped member and a left T-shaped member, each T-shaped member including an elongated vertical arm with a first end for mounting to one side of a horizontal frame member and a second end with a base member perpendicularly mounted thereto, the horizontal frame member including an upper frame area for the display of indicia, middle horizontal hang means for the displaying of products, and lower horizontal hang means for the displaying of products, the middle horizontal hang means including at least three parallel horizontal bars for accommodating pegboard style hooks for the hanging display of products, the three horizontal bars extending from a right side of the horizontal frame member to a left side of the horizontal frame member, the lower horizontal hang means including at least one lower horizontal bar extending from the right side of the horizontal frame member to the left side of the horizontal frame member.

6. The structure of claim 5, wherein the base members are mounted to a floor and provide base support for the structure.

7. The structure of claim 5, wherein the base members are mounted to a ceiling and the structure is suspended from a ceiling.

8. The structure of claim 5, wherein the right T-shaped member and the left T-shaped member are height-adjustable thereby enabling the structure to be height-adjustable.

9. A method of displaying products in a confined space, the method comprising:

hanging a structure from the ceiling, the structure being for the display of products, the structure including a right T-shaped member and a left T-shaped member, each T-shaped member including an elongated vertical arm with a first end for mounting to a horizontal frame member and a second end with a base member perpendicularly mounted thereto, the base members including means for mounting to the ceiling, the horizontal frame member including an upper frame area for the display of indicia, middle horizontal hang means for the displaying of products, and lower horizontal hang means for the displaying of products, the middle horizontal hang means including three parallel horizontal bars for accommodating pegboard style hooks for the hanging display of products, the three horizontal bars extending from a right side of the horizontal frame member to a left side of the horizontal frame member, the lower horizontal hang means for the displaying of products including at least one lower horizontal bar extending from the right side of the horizontal frame member to the left side of the horizontal frame member for the hanging display of products, attaching pegboard-type hooks to the middle horizontal hang means and hanging products from the pegboard-type hooks, hanging products from the lower horizontal hang means, whereby an area underneath the products hanging from the lower horizontal hang means is accessible for alternative uses such as counter space or the display of additional products.

10. A method of displaying products in a confined space, the method comprising:

placing a structure for the display of products on a floor, the structure including a right T-shaped member and a left T-shaped member, each T-shaped member including an elongated vertical arm with a first end for mounting to a horizontal frame member and a second end with a base member perpendicularly mounted thereto, each base member engaging the floor, the horizontal frame member including an upper frame area for the display of indicia, middle horizontal hang means for the displaying of products, and lower horizontal hang means for the displaying of products, the middle horizontal hang means including three parallel horizontal bars for accommodating pegboard style hooks for the hanging display of products, the three horizontal bars extending from a right side of the horizontal frame member to a left side of the horizontal frame member, the lower horizontal hang means including at least one lower horizontal bar extending from the right side of the horizontal frame member to the left side of the horizontal frame member for the hanging display of products, attaching pegboard-type hooks to the middle horizontal hang means and hanging products from the pegboard-type hooks, hanging products from the lower horizontal hang means, whereby an area underneath the products hanging from the lower horizontal display means and between the elongated vertical arms of the right and left T-shaped members is accessible for alternative uses such as counter space or the display of additional products.

11. The structure of claim 1, wherein the means for detachably mounting the right and left sides of the horizontal frame member to the first ends of the means for providing vertical support are disposed between two parallel bars of the middle horizontal hang means.

12. A structure for the displaying and selling of products in confined spaces, the structure comprising:

a horizontal frame member, means for providing vertical support for right and left sides of the horizontal frame member, the means for providing vertical support including a first end and a second end, the means for providing vertical support for the right and left sides of the horizontal frame member including a right T-shaped member and a left T-shaped member, each T--shaped member including an elongated vertical arm with a first end for mounting to the horizontal frame member and a second end having a base member perpendicularly mounted thereto, the base members providing base support for the structure when the base members are placed on a floor and the base members also being mountable to a ceiling when the structure is suspended from a ceiling, means for detachably mounting the right and left sides of the horizontal frame member to the first ends of the means for providing vertical support, the horizontal frame member including an upper area for the display of indicia, at least one middle horizontal hang means for the displaying of products, and at least one lower horizontal hang means for the displaying of products, each second end of the means for providing vertical support including a base member, each base member supporting the structure when the second ends are placed on a lower horizontal surface, each base member also being mountable to an upper horizontal surface, whereby the second ends may be placed on a lower horizontal surface for an upright configuration of the structure and the second ends may be suspended from an upper horizontal surface for an inverted configuration of the structure.

13. A structure for the displaying and selling of products in confined spaces, the structure comprising:

a horizontal frame member, means for providing vertical support for right and left sides of the horizontal frame member, the means for providing vertical support including a first end and a second end, means for detachably mounting the right and left sides of the horizontal frame member to the first ends of the means for providing vertical support, the horizontal frame member including an upper area for the display of indicia, at least one middle horizontal hang means for the displaying of products, and at least one lower horizontal hang means for the displaying of products, the lower horizontal hang means includes three parallel horizontal bars disposed above at least one lower horizontal bar, each bar extending from the right side of the horizontal frame member to the left side of the horizontal frame member, each second end of the means for providing vertical support including a base member, each base member supporting the structure when the second ends are placed on a lower horizontal surface, each base member also being mountable to an upper horizontal surface, whereby the second ends may be placed on a lower horizontal surface for an upright configuration of the structure and the second ends may be suspended from an upper horizontal surface for an inverted configuration of the structure.

14. A structure for the displaying and selling of products in confined spaces, the structure comprising:

a horizontal frame member, means for providing vertical support for right and left sides of the horizontal frame member, the means for providing vertical support including a first end and a second end, means for detachably mounting the right and left sides of the horizontal frame member to the first ends of the means for providing vertical support, the horizontal frame member including an upper area for the display of indicia, at least one middle horizontal hang means for the displaying of products, and at least one lower horizontal hang means for the displaying of products, the upper area for the display of indicia, the middle horizontal hang means and the lower horizontal hang means are width adjustable thereby enabling the structure to be width adjustable, each second end of the means for providing vertical support including a base member, each base member supporting the structure when the second ends are placed on a lower horizontal surface, each base member also being mountable to an upper horizontal surface, whereby the second ends may be placed on a lower horizontal surface for an upright configuration of the structure and the second ends may be suspended from an upper horizontal surface for an inverted configuration of the structure.

* * * * *